US006393707B1

(12) United States Patent
Maffei

(10) Patent No.: US 6,393,707 B1
(45) Date of Patent: May 28, 2002

(54) SLIDE RULE AND INDICATOR WHICH CAN ALSO BE COMBINED WITH BOXES FOR MEDICINES AND OTHER ITEMS

(75) Inventor: Michele Maffei, Pistoia (IT)

(73) Assignee: Promo Service di Michele Maffei & C. S.A.S. (IT)

( * ) Notice: Subject to any disclaimer, the term of this patent is extended or adjusted under 35 U.S.C. 154(b) by 0 days.

(21) Appl. No.: 09/380,191

(22) PCT Filed: Mar. 16, 1998

(86) PCT No.: PCT/IT98/00057

§ 371 (c)(1),
(2), (4) Date: Aug. 26, 1999

(87) PCT Pub. No.: WO98/41945

PCT Pub. Date: Sep. 24, 1998

(30) Foreign Application Priority Data

Mar. 19, 1997 (IT) ..... PT97A0001

(51) Int. Cl.[7] ..... B65D 27/04

(52) U.S. Cl. ..... 33/15 D; 206/459.1; 206/232

(58) Field of Search ..... 33/15 D, 1 F, 1 U, 33/156, 494, 679.1, 522; 206/459.1, 232, 831; 229/116.1; 40/312, 313; 116/321, 322, 323, 324; 235/70 R, 70 A, 70 B–70 D; 283/65; 493/325, 63, 75, 76, 374, 379

(56) References Cited

U.S. PATENT DOCUMENTS

| | | | | |
|---|---|---|---|---|
| 3,769,727 A | | 11/1973 | Kent, Jr. | |
| 3,902,656 A | * | 9/1975 | Rothchild | 229/75 |
| 4,140,895 A | * | 2/1979 | Tatai | 235/89 R |
| 4,233,768 A | | 11/1980 | Bromberg | |
| 4,413,730 A | * | 11/1983 | Morse | 206/232 |
| 5,409,381 A | * | 4/1995 | Sundberg et al. | 434/159 |
| 5,778,578 A | * | 7/1998 | Drapcho et al. | 40/491 |
| 6,129,388 A | * | 10/2000 | Bromberg | 283/65 |
| 6,209,780 B1 | * | 4/2001 | Jensen | 229/103 |

FOREIGN PATENT DOCUMENTS

| | | |
|---|---|---|
| EP | 0 372 607 | 6/1990 |
| GB | 2 110 848 A | 6/1983 |

* cited by examiner

*Primary Examiner*—Diego Gutierrez
*Assistant Examiner*—R. Alexander Smith
(74) *Attorney, Agent, or Firm*—McGlew and Tuttle, P.C.

(57) ABSTRACT

A cursor (151), designated to slide in a case formed by two thicknesses lying alongside the cursor, is formed by cuts parallel to the direction of sliding and by weak links designed to be broken by action on the cursor (151) in the direction of f1 which causes its initial sliding; cuts parallel to the direction of sliding form elongate slots (153) running alongside the cursor (151) and each terminating in a stop (151X) formed by the cursor and in a stop (121x) formed by the material of the intermediate thickness (121) from which the cursor is formed; the two stops (121X; 151X) interact to limit the sliding of the cursor with respect to the case.

19 Claims, 13 Drawing Sheets

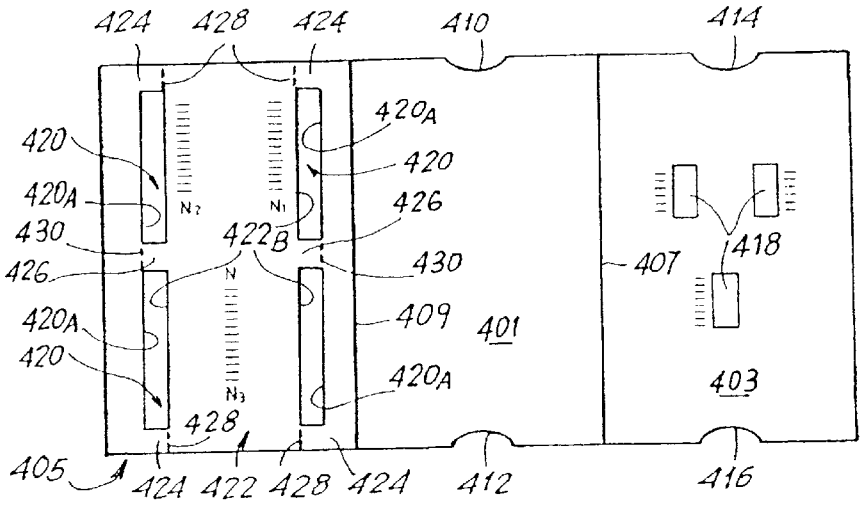
FIG.14
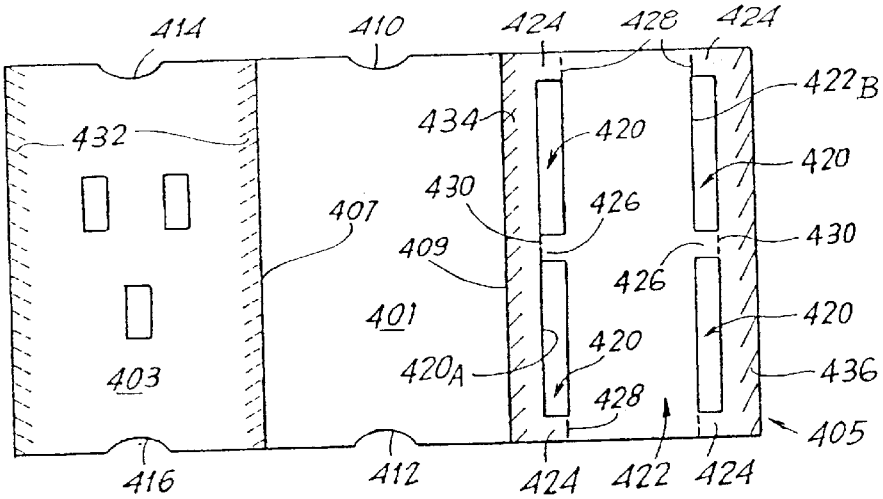
FIG.15
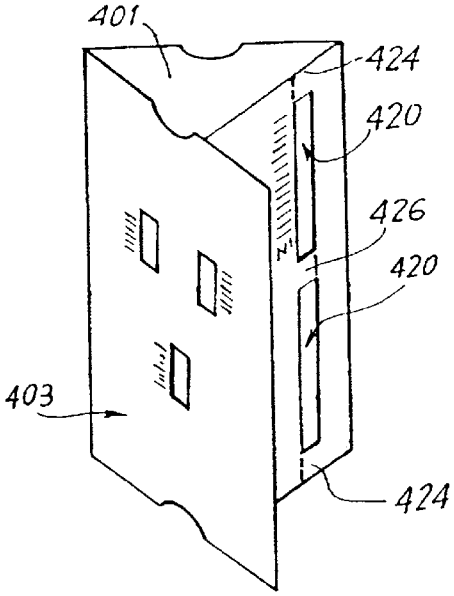
FIG.16
FIG.17
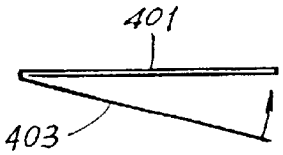

FIG. 24
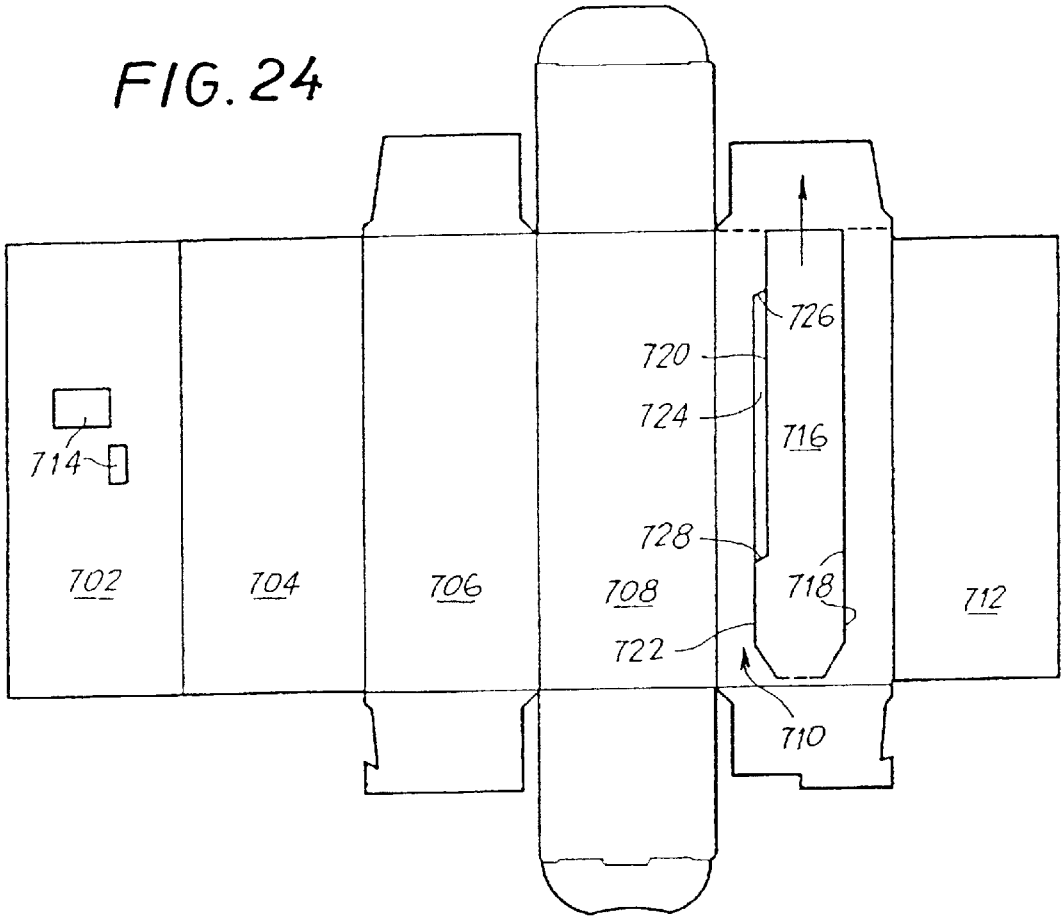
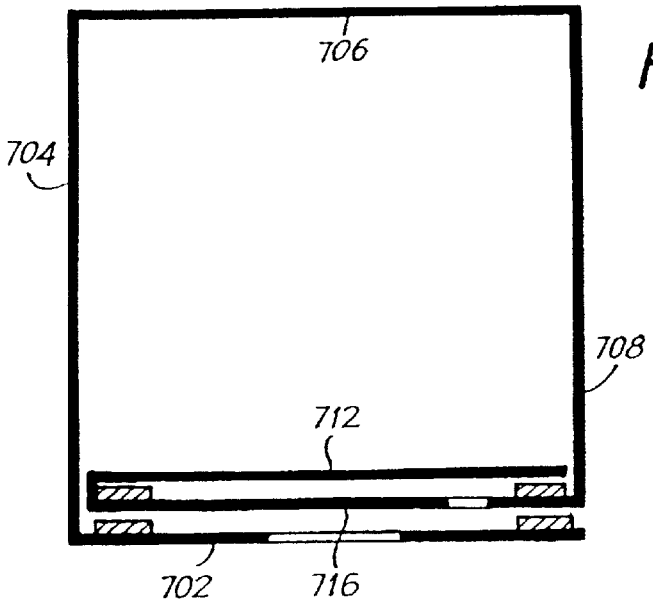
FIG. 25

SLIDE RULE AND INDICATOR WHICH CAN ALSO BE COMBINED WITH BOXES FOR MEDICINES AND OTHER ITEMS

FIELD OF THE INVENTION

The device in question is designed to eliminate some typical steps relating to the manufacture and assembly of what are known as rules in general (slide rules and indicators) which can also be combined with boxes to contain, for example, medicines. The term "rules" is taken to signify all those devices (widely used in the fields of mechanical engineering and pharmacology, and in scientific and promotional subjects) which, when a cursor is slid within a suitable envelope case, indicate data or carry out true mathematical calculations by the juxtaposition of prepared logarithmic or decimal scales. The rule, as described above, is commonly made from paper or plastic material or similar, since these materials are most suitable for the construction of this device, given that the envelope case is simply a flat surface printed and folded on to itself at two or three points and fixed in this position either by a spot of adhesive or by a suitable insertion joint; at its upper and lower ends, this folded surface has an aperture which can receive what is known as the cursor and allow it to slide.

By sliding the cursor within the case and with the aid of suitable apertures (stamped out of the case if cardboard is used or transparent if plastic material is used) it is possible to indicate data or to perform easily calculations which would otherwise be more difficult to obtain (by devising formulae, using calculators, etc.).

BACKGROUND OF THE INVENTION

One of the principal problems encountered in manufacture, whether on a small business footing or on an industrial scale where the effects are greater, is that of the insertion of the cursor into the envelope case, which in most cases has to be carried out manually. This is because this type of product is commonly manufactured in small batches without continuity in time, commonly for promotional purposes, for which it is economically unsound to construct suitable machinery capable of carrying out the casing operation, with the further consideration that the rules commonly vary rather widely from each other in terms of dimensions and content. In order to overcome this problem, which increases the time and consequently also the costs of production, the device illustrated below has been conceived.

SUMMARY AND OBJECT OF THE INVENTION

The device is designed to achieve the simplified assembly of rules or boxes including rules, made from paper or other similar materials, and simultaneously of the structures containing them, by means of a distinctive development in the plane of the model to be produced and the consequent appropriate preparatory stamping which, when paper or other similar material is used, enables a cursor slidable within a case to be produced without the necessity of assembling the cursor manually within the case. This is made possible because the mechanical assembly is carried out on the same printed sheet after a simple stamping operation, using commonly and easily used machines employed in the paper and cardboard industry (gluing and folding machines).

The customary device may be used to provide the preparation of a box or casing wherein one or more rules form one or more walls of the box.

One object of the invention is to provide, at the same time as and in addition to an easy operation of assembling the blank, an easy cursor function, preventing the exit of the cursor from the case forming the sliding housing during the cursor sliding operations, and in particular on the occasion of the first of these operations.

Another object of the invention is to make the sliding of the cursor in its housing very smooth and free of obstacles and impediments. These and other objects and advantages will be made clear by the following text.

The invention therefore relates to a device forming a slide rule and indicator—which can also be combined with boxes containing medicines and other items—which can be made from paper or cardboard, which comprises a structure having three thicknesses or panes, of which the two outer ones form a case and the intermediate one forms a cursor designed to slide in the case; the cursor is formed by cuts parallel to the direction of sliding of the cursor and by weak links designed to be broken by action on the cursor to cause the initial sliding. According to the invention, cuts parallel to the direction of sliding of the cursor form at least one elongate slot running alongside the cursor and terminating in one stop formed by the cursor and in one stop formed by the material of the intermediate thickness from which the cursor is also made; the said two stops interact to limit the sliding of the cursor with respect to the case to the distance represented by the length of the slot.

The said two stops can be inclined with respect to the direction of sliding of the cursor and with respect to the perpendicular to the said direction of sliding, to obtain an angle of less than 90° between the edges sliding with respect to each other. This facilitates the uniform sliding of the cursor.

It is also possible to provide slots running alongside the cursor on the two opposite sides.

It is possible to provide two slots running along one or each of the sides of the cursor, two outer stops formed by the sliding case and a double stop movable with the cursor in the interspace delimited by the two outer stops; in this way the cursor can be moved in the two opposite directions with respect to the retention position.

A slot may be made by forming a discard to be removed from the paper material from which the cursor is formed, or by a perimetric of the blank in which the cursor is formed along the perimeter of the blank.

The cursor may be integral with a closing tab of a box, this tab thus forming a convenient grip for sliding the cursor.

The weak links designed to be broken on the occasion of the initial sliding of the cursor may be formed along lines inclined with respect to the direction of sliding of the cursor, thus preventing irregular edges from sliding along each other; this facilitates the uniform sliding of the cursor.

In an embodiment in the form of a prismatic box, it is also possible to provide two or more cursors on adjacent or non-adjacent faces.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIGS. 14 to 17 show a front view and a rear view of a blank for the formation of a rule with a cursor, and the rule in the process of being folded, in a perspectives view and in transverse section;

FIGS. 24 with 25, 26 with 27, 28 with 29 show the development of the blank and transverse sections through the assembled box in other embodiments of boxes.

DESCRIPTION OF THE PREFERRED EMBODIMENT

Figure 1:
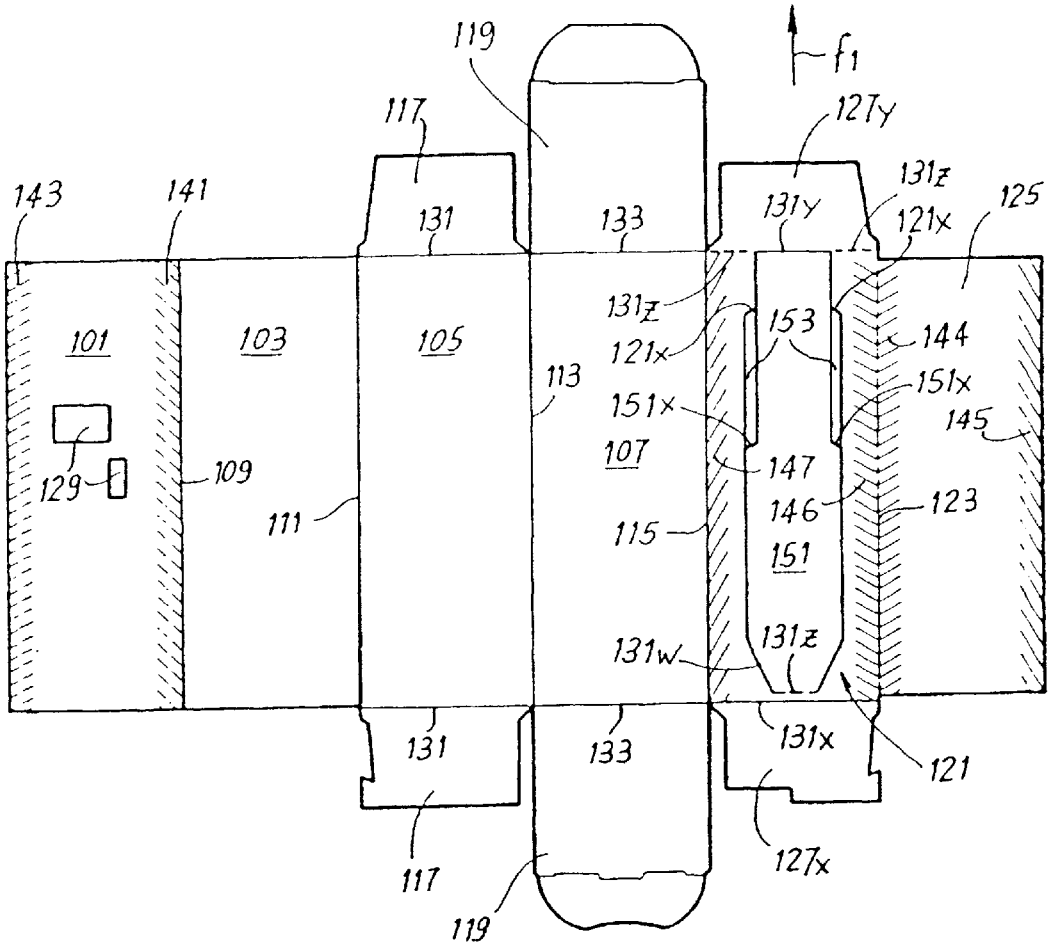
FIGS. 1 to 4 show a sequence of steps of folding and gluing an example of a blank to form a box, FIG. 1 showing the face opposite what will be the outer printed face in the finished box.
Figure 5:
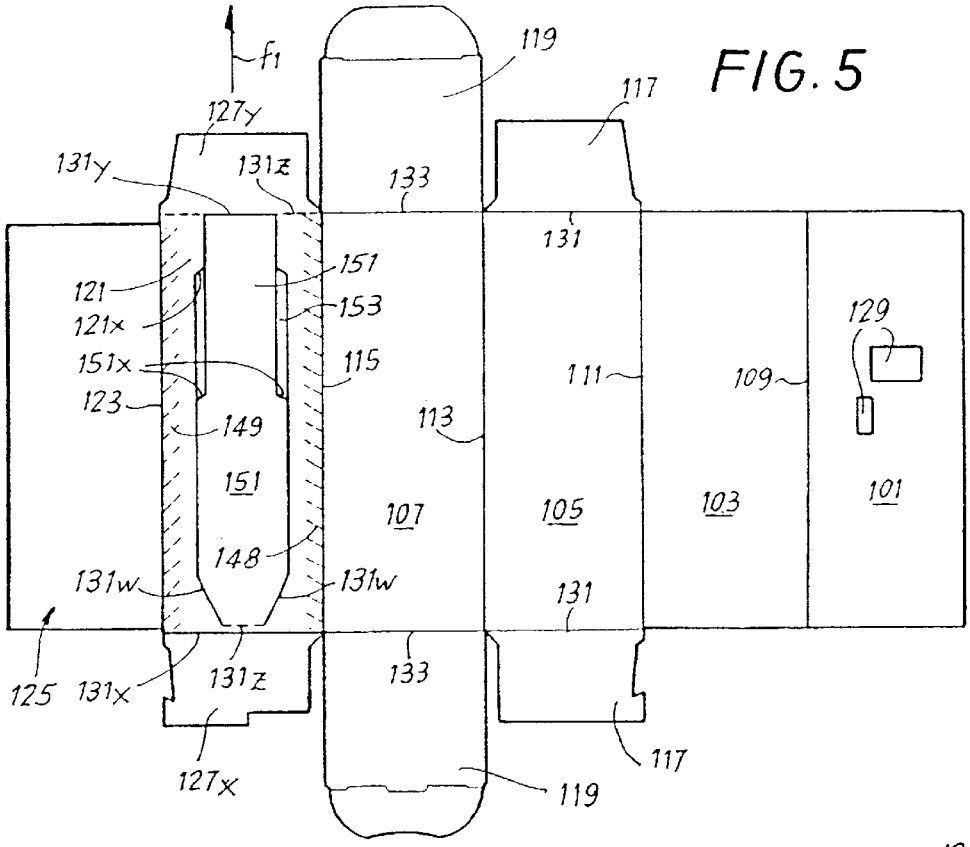
FIG. 5 shows the blank from the face opposite that shown in FIG. 1.

FIGS. 1 to 8 show a solution consisting of a prismatic box with principal faces or panes 101, 103, 105, 107 which form the body of the box, being delimited by fold lines 109, 111, 113 and 115; two tabs 117 extend from the face 105, while two appendages 119 extend from the origin 107 and are used to close the ends of the prismatic box. A face or cursor pane 121 which is treated as stated below to form the cursor is formed beyond the fold line 115; the face 121 is further delimited by a fold line 123, from which an inner face 125 extends. Tabs 127X, 127Y similar to the tabs 117 extend from the face 121. In the face 101 there are formed apertures 129 positioned to permit the use and display of the indications which are formed in the cursor made from the face 121 in the way stated below. The tabs 117 and the appendages 119 are delimited by fold lines 131 and 133 respectively. The tabs 127X 127Y are delimited by lines equivalent to the lines 141 but having a different structure as stated below. FIG. 1 shows the box blank from the inner surface of the assembled box, while FIG. 5 shows the outer surface of the blank, which is printed. In the drawing, and in particular in FIGS. 1 and 5, the areas moistened with adhesive for the assembly of the box are shown by hatching in different directions. Gluing strips 141 and 143 are provided (FIG. 1) along the longitudinal sides of the rectangle of the face 101 on the inner surface of the blank along the fold line 109 and along the opposite terminal edge. Two gluing strips 144 and 145 are provided on the face 125 along the fold line 123 and along the opposite terminal edge. Gluing strips 146 and 147 are provided on the face 121 along the fold lines 123 and 115. Two gluing strips 148 and 149 are provided on the face 121 on the outer surface of the blank (FIG. 5), along the fold lines 115 and 123 respectively.

The cursor 151 is formed from the face 121 and extends from the fold line 131X of the tab 127X up to the tab 127Y across the fold line 131Y. The cursor 151 is slightly tapered at its lower end (as seen in FIGS. 1 and 5) along inclined lines 131W to a transverse line 131Z; the lines 131W and/or 131Z are partly cut and partly perforated or in some way weakened to provide a link to the tapered end of the cursor 151, the said link being easily breakable by a pull in the direction of the arrow f1. The cursor 151 is joined to the tab 127Y along the fold line 131Y, only in the central area of the length of the side separating the face 121 from the tab 127Y; on the sides of the fold line 131Y there are two fold lines 131Z, which are also (like the aforesaid lines 131W and/or 131Z) weakened by perforations or by cuts or by reductions in thickness of the paper material forming the blank for the box. These weakened lines ensure the security of the link between the material of the cursor 151 and the material or frame surrounding it, but make it easy to separate the cursor 151 from the surrounding material or frame when a force is applied to the cursor 151 in the direction of the arrow f1. The pulling action in the direction of the arrow f1 may be exerted by grasping the tab 127Y and pulling in the said direction of the arrow f1, in such a way as to detach the cursor 151 by tearing the lines 131Z and/or 131W. The cursor 151 is delimited laterally along its length by complete cuts extending longitudinally and parallel to the fold lines 115 and 123 and by areas in which portions of material forming discards are removed, to form two elongate apertures 153; the elongate slots 153 are delimited by a stop 121X formed by the material of the face 121, and by a stop 151X formed by the material of the cursor 151. The face 121 therefore delimits an extensive rectilinear longitudinal sliding area or frame opening and the cursor 151 has its transverse dimension reduced at the position of the two apertures 153 and as far as the fold line 131Y. With this disposition, when the cursor 151 (linked securely to the tab 127Y by the fold line 131Y) is pulled in the direction of the arrow f1, a separation is caused along the perforated or weakened lines 131Z and 131W and it becomes possible to slide the cursor 151. The cursor 151 is able to travel but only to a limited extent, over a distance corresponding to the extension of the elongate slots 153, between the two stops 121X and 151X in the conditions shown in FIGS. 1 and 5. This prevents the risk of extracting the cursor 151 from its sliding housing, particularly on the occasion of the first sliding, when the separation has to be caused along the lines 131W and 131Z. The slots 153 can be extended over a longer distance than that shown in the drawing, since a limited length of the wider area of the cursor is sufficient for guiding the cursor, so that a more extended sliding of the cursor is possible along the longitudinal cut lines which delimit the cursor and the slots 153, but with secure guidance of the cursor along sliding lines which are spaced apart. Clearly, the cursor operations will be carried out after completion of the assembly of the box, when the cursor is contained between the two faces 101 and 125, between which faces the cursor 151 is located after the assembly of the box as described below. The slots 153 are delimited by inclined terminal lines which facilitate the sliding of the cursor in both directions without impediments; this is because the angle between the longitudinal edge in the direction of sliding of the cursor and the edge delimiting the stop which slides along it is less than 90°.

Figure 2:
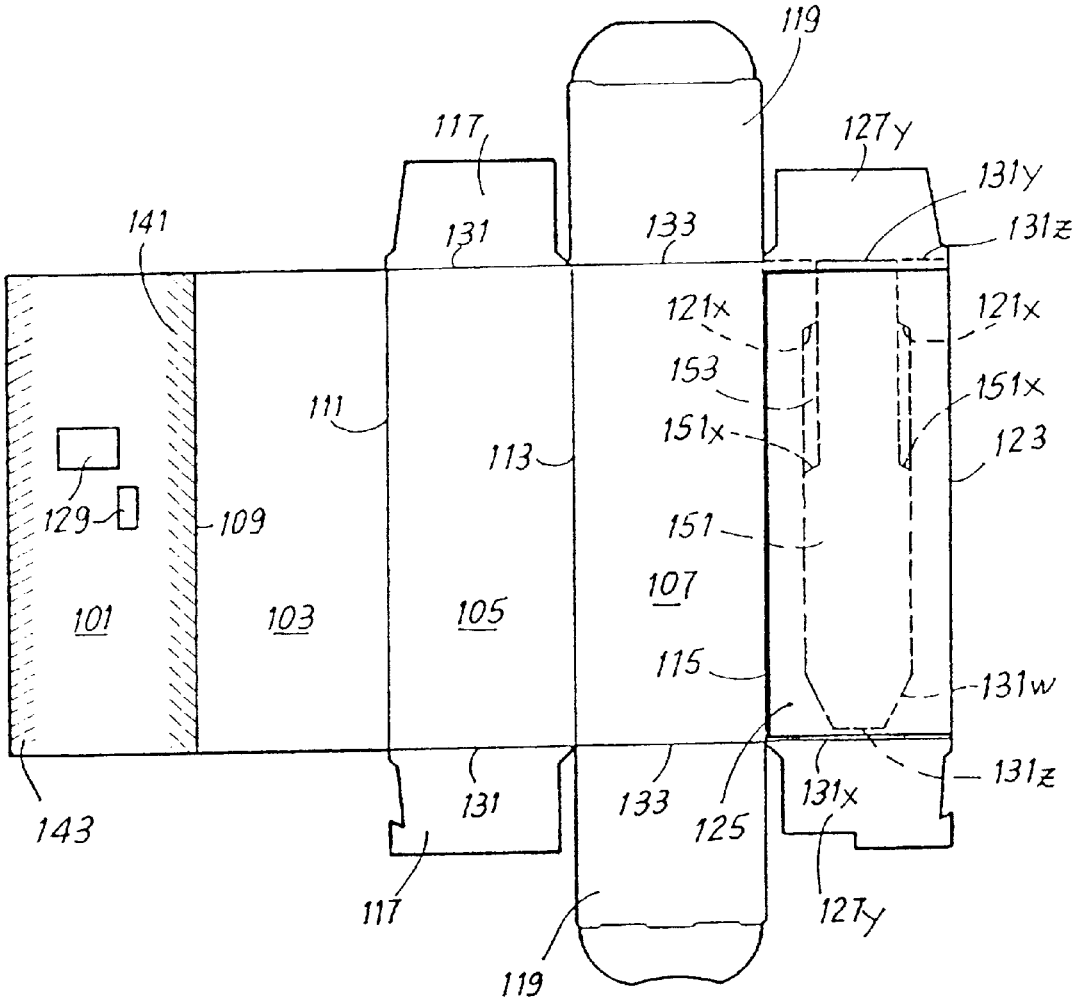
Figure 3:
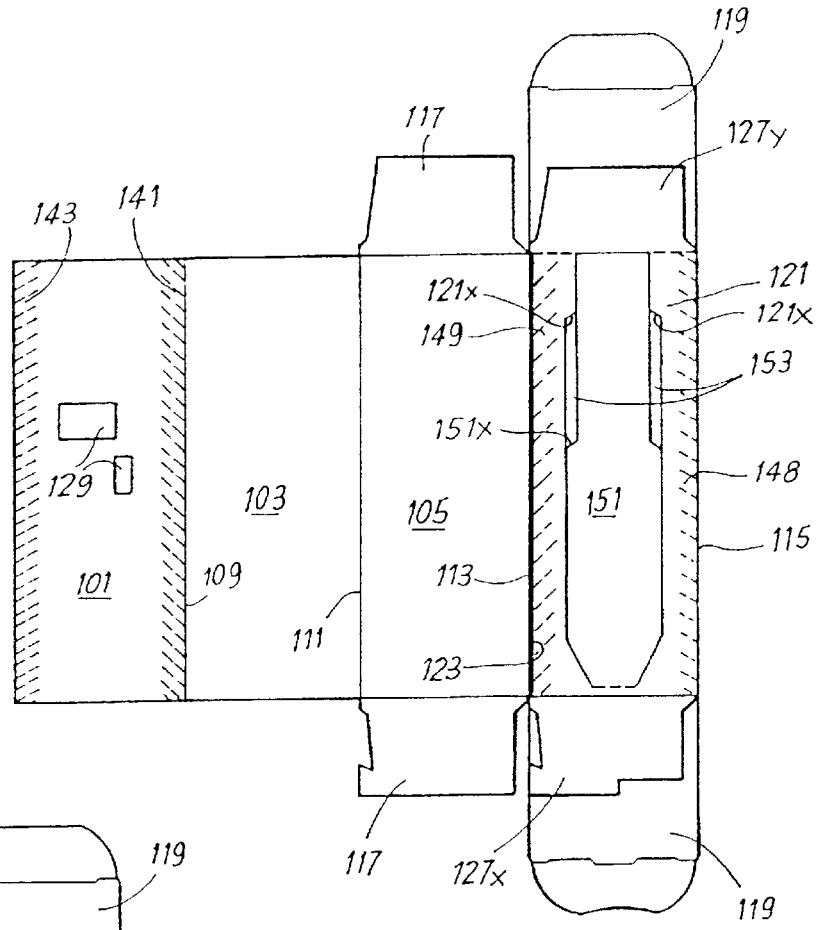
Figure 4:
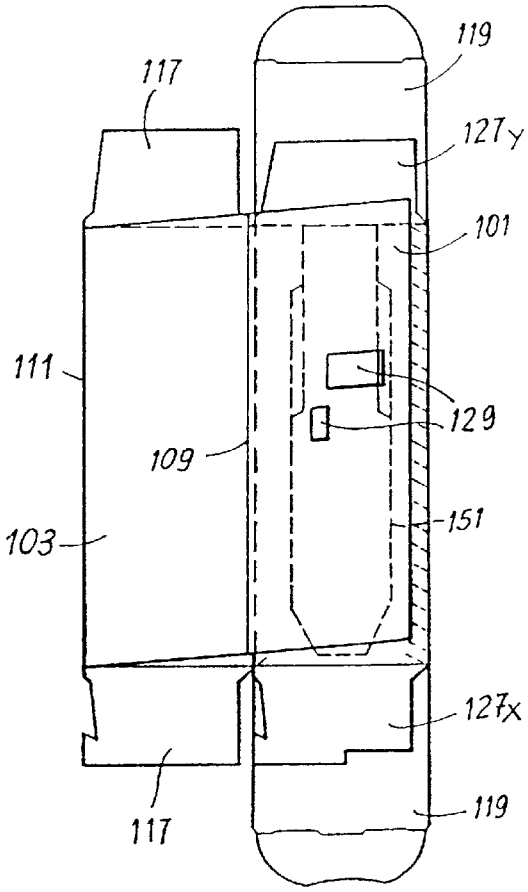

With reference to the sequence shown in FIGS. 1 to 4 and with reference also to the perspective diagrams 6 and 8, the assembly procedure is as follows. The stamped piece as shown in FIG. 1 undergoes a first fold along the fold line 123 to turn the face 125 over onto the face 121 and therefore on the inside of the face 121, in such a way that the gluing strips 144 and 146 and similarly the gluing strips 145 and 147 are joined together; in this way the configuration shown in FIG. 2 is obtained. The two faces 125, 121 (joined together) are then turned over about the fold line 115 against the face 107, to provide the configuration shown in FIG. 3. In these conditions illustrated in FIG. 3, the gluing strips 148 and 149, adjacent to the fold line 115 and the fold line 123 respectively, are exposed. A following step of assembly can be discovered by a comparison between FIGS. 3 and 4; in this step the pair of faces 103 and 101 is folded along the fold line 111 in such a way that the face 101 comes to bear on the outer surface of the face 121 and the gluing strips 141 and 143 are joined to the gluing strips 149 and 148 respectively. In this way the loop consisting of the faces 101, 103, 105 and 107 is closed, while the face 121 is located inside the face 101 and the face 125, in turn, is located inside the face 121. The cursor is contained between the face 101 and the face 125 which are joined by the eight gluing strips provided on the two surfaces of the face 121 along the fold lines 115 and 123. In these conditions the box can be bent to create the prismatic volume which can be formed by it. After the insertion of the contents into the box, the latter can be closed by folding the tabs 117 and 127 through 900 with respect to the corresponding faces and then by folding the appendages 119 on the top and outside of the tabs and by engaging them by their additional insertion between the tabs and the face opposite the hinge face delimited by the fold lines 133 for the tabs 119. The box is thus closed in the same way as a conventional box.

Figure 6:
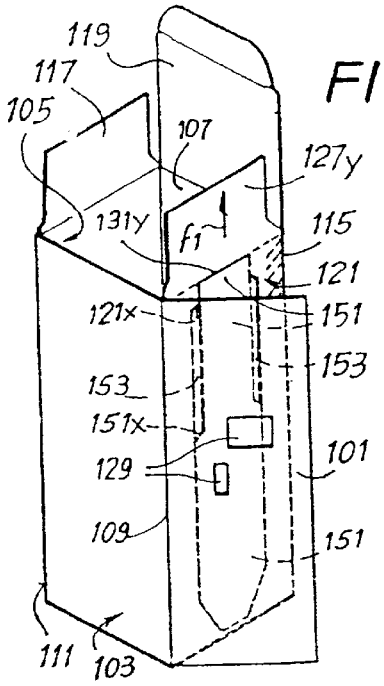
FIGS. 6 and 7 show the box partially formed, in a perspective view and in transverse section.
Figure 7:
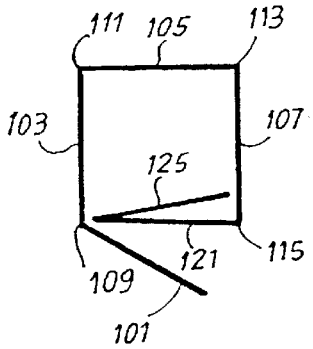
Figure 8:
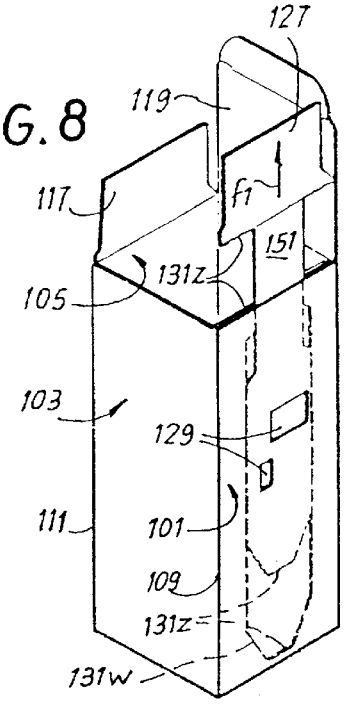
FIG. 8 shows in perspective the assembled box, open and with the cursor partially made to slide.
Figure 9:
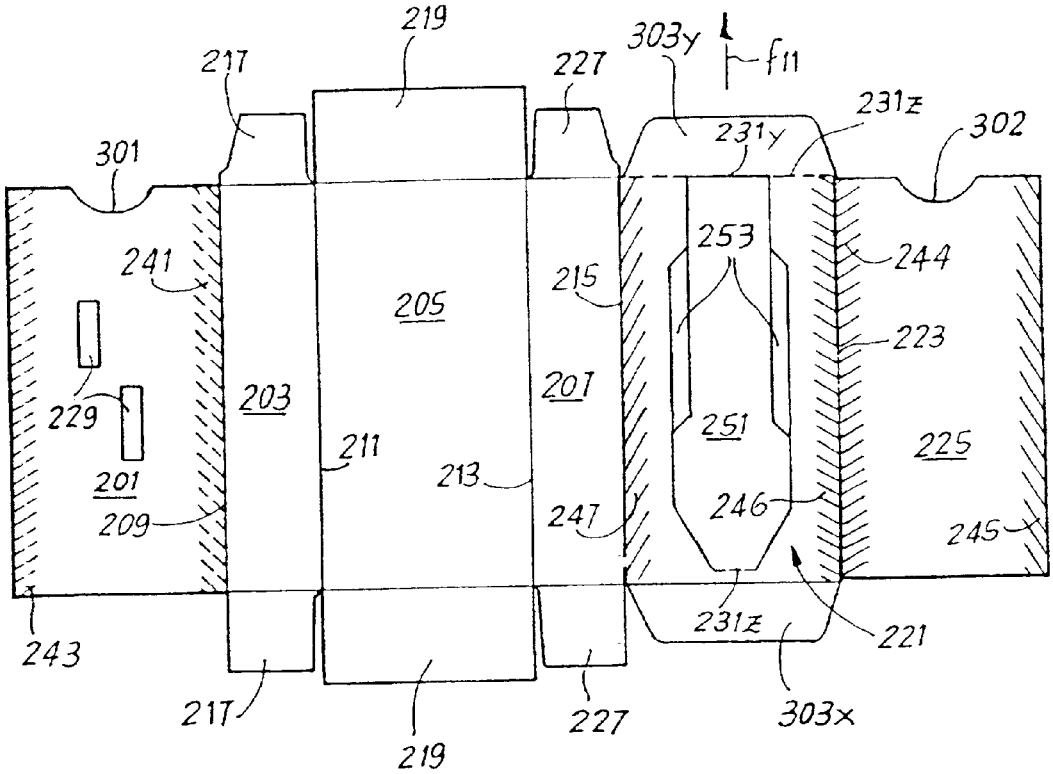
FIGS. 9, 10, 11 and 12 show a sequence of steps of folding and gluing a further example of a blank to form a box.
Figure 10:
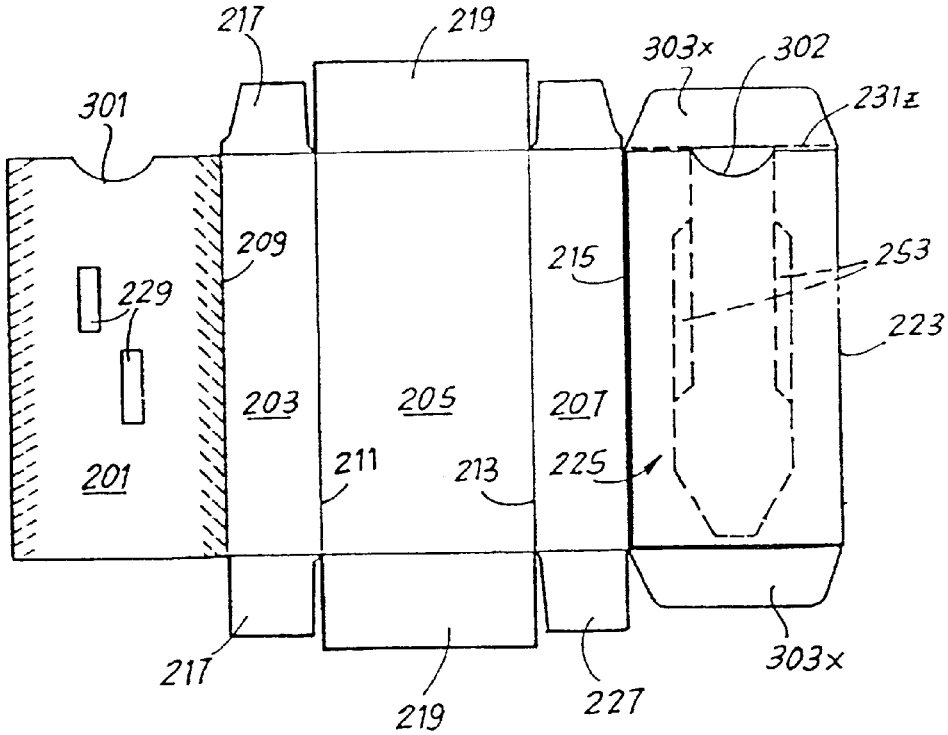
Figure 11:
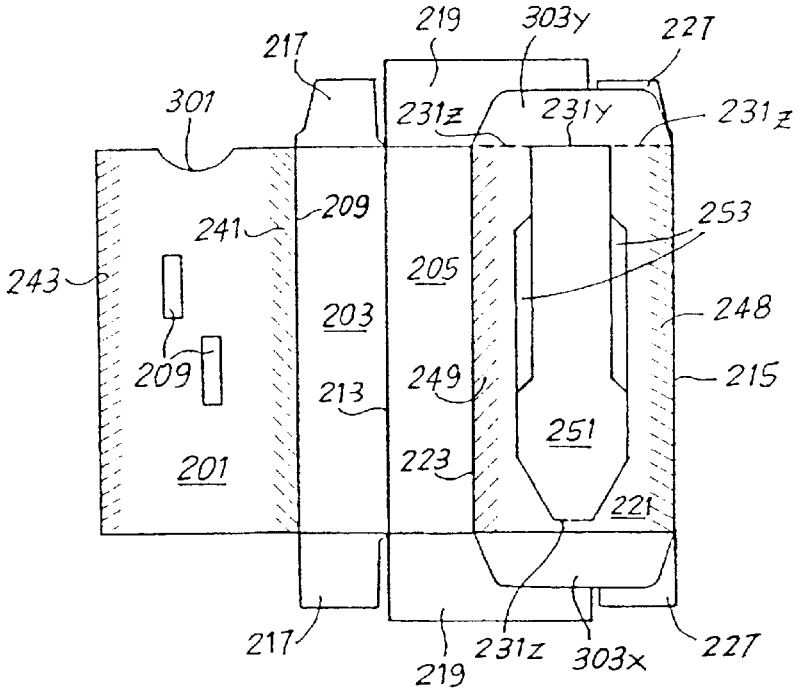
Figure 12:
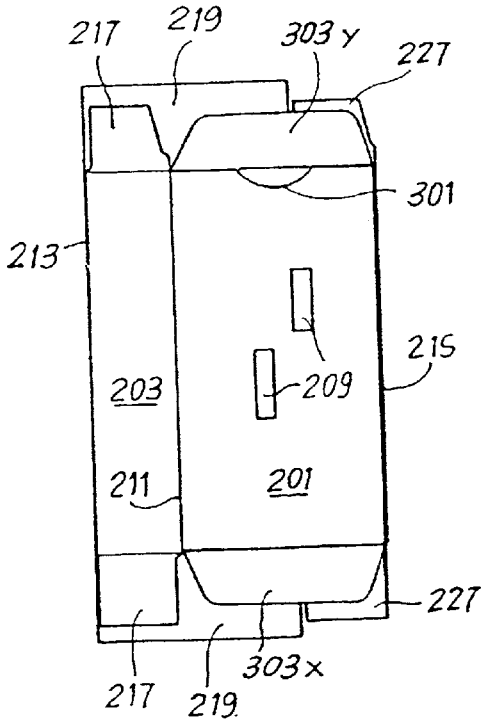

When it is desired to open the box and also to consult the data, provided by the sliding of the cursor 151, the appendage 119 which is next to the tab 127Y is raised; additionally, at least the tab 127Y is also raised as shown in FIG. 6 so that the tab 127Y can be grasped with the fingers and pulled in the direction of the arrow f1 (see also, and in particular, FIGS. 6 and 8) which causes the cursor 151 to be detached from the three weakened linking lines 131Z each of which is in alignment with either the lower fold line 131X or the upper fold line 131Y; in this way the cursor 151 is detached from the face 121, while the cursor 151 remains linked to the face 121 during the assembly operations by the three upper and lower weakened linking areas 131Z. The cursor 151 can then be made to slide longitudinally by an action exerted again on the tab 127Y, as a result of which the desired readings can be taken through the slots 129, which enable the desired information to be obtained by the sliding and positioning of the cursor 151 to appear and to be made visible. The cursor 151 can travel as permitted by the slots 153 (when the discards delimited by these slots have been removed); the cursor can only carry out limited movements, but is prevented from leaving its housing which is formed between the two faces 101 and 125 and by the side walls of the cursor which are delimited by the longitudinal cuts formed in the face 121.

It should be noted that the blank is printed on a single side of the blank material, namely on the surface which is visible in FIG. 5, on the four faces of the box and also on the surface of the cursor 151 on which are shown the data to be made visible through the slots 129.

The box is assembled by entirely conventional operations of folding and of joining the gluing strips which are located on the inner face (the gluing strips 141, 143, 144, 145, 146, 147) and the gluing strips 148 and 149 (which are located on the outer face).

During the operations of assembly by the described folding steps, the cursor 151 continues to be secured by the link—not yet broken—represented by the three weakened fold lines 131Z, of which two lie on the fold line 131Y and one lies between the two portions of the lower fold line 131X.

The detachment of the cursor 151—to permit its sliding—can be carried out easily by the simple breaking of the three weakened folding and detachment areas 131Z in the way indicated above by pulling in the direction of the arrow f1, after which the cursor is free to slide in a closely guided way and within the limits provided by the length of the slots 153.

Figure 13:
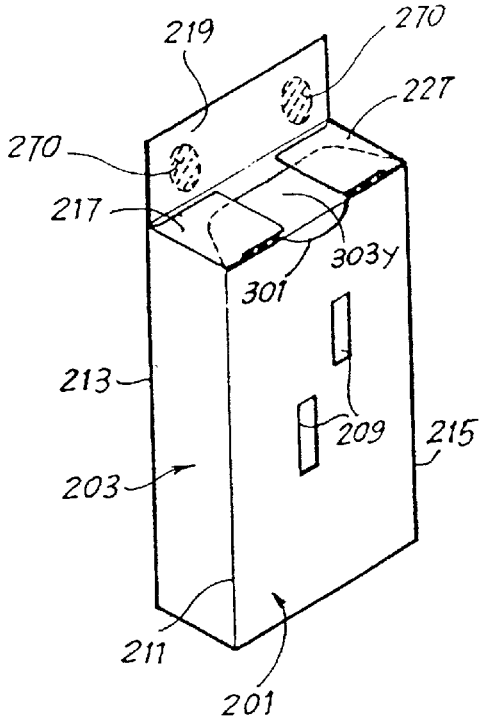
FIG. 13 shows in perspective the box shown in FIGS. 9 to 12, partially opened.

FIGS. 9 to 13 show a solution in the form of a box which is usually intended for one-time use, in other words to be disposable, for products which are consumed on a single occasion. The same reference numerals used for FIGS. 1 to 8, increased by "100", are used for equivalent parts of this modified solution, in which slots 253 equivalent to the slots 153 are provided. In addition to the different transverse dimensions of the faces 203, 207, the box being relatively flattened in this case, the modifications comprise, in particular: the presence of indentations 301 and 302 on the upper edges (looking at the drawing) of the faces 201 and 225 respectively; the different positions of the upper and lower tabs 217 and 227; and the different extensions of the upper and lower appendages 219, these being limited to the dimension of the transverse section of the assembled box without the extension which can be folded for insertion along the opening edge of the box. The face 221, in which the cursor 251 is formed, has extensions 303X and 303Y modified as to their shape with respect to the extensions which in the preceding example are formed by the tabs 127X and 127Y. In the modified disposition, the box can be folded as shown by the sequence of FIGS. 9, 10, 11 and 12. The portion 225 is made to be bent down against the portion 221 along the fold line 223 to join the gluing strips 244 and 246 and similarly 245 and 247; the two portions 221 and 225 (joined together) are then made to be turned over along the fold line 215, to obtain the configuration shown in FIG. 11; a fold is then made along the line 213 to move from the configuration in FIG. 11 to the configuration in FIG. 12 with the gluing strips 248 and 249 joined to the gluing strips 243 and 241 respectively. From the configuration thus obtained and illustrated in FIG. 12, the box can be formed by folding along the fold lines 209, 211, 213, 215. When the prismatic configuration of the box has been obtained, the extensions 303X and 303Y are folded, and then the tabs 217 and 227 are folded and bent down on to the extensions 303X and 303Y, as shown in FIG. 13; or, conversely, the tabs 217 and 227 may be bent down first and the extensions 303X and 303Y may be bent down on to them afterwards. Finally, the appendages 219 are bent down and fixed with gluing spots 270 either on to the tabs 217 and 227 or on to the extensions 303X and 303Y.

When the box is to be opened, the extension 219 nearer the extension 303Y next to the indentations 301, 302 is raised, so that the gluing spots 270 are separated and the tabs 217 and 227 can be raised; to operate the cursor 251, the extension 303Y which is linked to the cursor 251 by the fold line 231Y (which is not weakened) is raised; the extension 303Y is then grasped and the cursor is acted on in the direction of the arrow f11 to detach the three weakened areas 231Z or equivalent; the cursor 251 can again be slid to consult the data on it through the slots 229 equivalent to the slots 209. The contents may be extracted from the box which has been opened in this way. A more convenient grip on the cursor 251 is provided by the indentations 301, 302, in addition to the surface provided by the extension 303Y, or with the separation of the said extension 303Y from the cursor 251 by the operation of raising the extension 219 which has been glued at the areas 270 to the extension 303Y, and with action on the areas of the cursor 251 which are left exposed by the two indentations 301, 302.

FIGS. 14 to 17 show the construction of a rule to be used separately from a box. The cardboard blank comprises three faces 401, 403, 405, delimited by two fold lines 407 and 409. The faces 401 and 403 have semicircular notches or indentations 410, 412 and 414, 416, which are brought together in pairs by folding along the line 407. The face 403 has reading apertures 418. The face 405 has two pairs of rectangular slots 420, aligned two by two and extending parallel to the fold lines 407 and 409; the outer longitudinal sides of the apertures 420 form guide edges 420A, and the inner longitudinal sides 422B, opposite the edges 420A, delimit the cursor 422 formed from the face 405. The four apertures 420 are further delimited by four outer appendages 424 forming an integral part of the face 405 (divided into two portions by the cursor 422), and by two intermediate appendages 426 forming an integral part of the cursor 422. The said four appendages 424 are linked to the cursor 422 by lines of incomplete cutting 428, aligned with the edges of the longitudinal sides 422B; the two intermediate appendages 426 are linked to the two portions of the face 405 by lines of incomplete cutting 430, aligned with the guide edges 420A.

The three faces 401, 403, 405 (the last of these comprising the part 422 forming the cursor) are printed on their sides shown in FIG. 14, while the opposite sides, shown in FIG. 15, of the faces 403 and 405 have gluing areas 432, 433 and 434, 436 respectively.

By folding the face 405 (with the cursor 422) along the fold line 409, the areas 434, 436 on the side of the face 401 shown in FIG. 15 are glued down; then, by folding the face 403 along the fold line 407, the areas 432, 433 along the portions of the face 405 running alongside the cursor material 422, outside the apertures 420, are glued down.

The cursor 422 is contained between the two faces 401, 403, and is temporarily retained by the lines of incomplete cutting 128, 130, and partially exposed at the positions of the corresponding semicircular notches or indentations 412, 416, through which the cursor can be gripped and made to slide parallel to the fold lines 407, 409 along the edges 420A, 420B, after the cursor has been separated along the weak temporary link lines 428, 430.

The rules and the boxes made as described above provide noteworthy advantages, since, among other considerations, they make it possible:

1) to print sheets of cardboard (or other material) on one side only, in other words on the side shown in FIG. 14, which in itself yields a considerable economic advantage;
2) to keep all the gluing surfaces on a single side (on the side shown in FIG. 15, opposite the printed side), thereby providing a further advantage;
3) to use conventional folding and assembly operations to produce the rule which provides the envelope case and cursor in a single unit;
4) to form stops to prevent the accidental removal of the cursor from its sliding case;
5) to carry out, with simple folding machines (commonly used in the paper and cardboard industry for mechanized production of boxes, cases or other items) the gluing and folding operation, on completion of which the rule is assembled and ready for use without the need to carry out any supplementary operation.

To use the rule, for example, the user simply has to apply a gentle initial pull to release the cursor from the thin fixing points and to make it slide in the desired direction. Owing to the presence of the indentations 410 to 416, formed by semicircular voids, it is possible to grip the edges (upper and lower) of the cursor 422, pulling on these and thus causing the tearing of the weak link areas 428, 430 and the detachment of the cursor, and consequently causing, by pulling, the movement of the cursor; this makes it possible, through the appropriate slots 418 on the face 403, to read the data printed on the cursor and to display data or, by using calibrated logarithmic scales, to obtain calculations of various types and significance, suitably printed on one side of the cursor.

The outer appendages 424 act as four stop flaps for the cursor, interacting with the intermediate appendages 426 in such a way as to limit the travel of the cursor and to prevent it from leaving the case formed by the two faces 403, 401. By changing the positions of the appendages, the travel of the cursor 422 can be varied in both directions.

The rule may also be made so that data can be read from the two opposite sides of the rule. In this case, it is necessary to print the cardboard on both sides and to provide slots additionally in the face 401 (as well as in the face 403), to permit the display of the printed data on both faces of the cursor.

Further developments of the invention may permit the preparation of box structures made from paper or similar materials which contain rules in boxes of various shape (with square, triangular, hexagonal or other cross-sections) and which may also have two or more rules.

Figure 18:
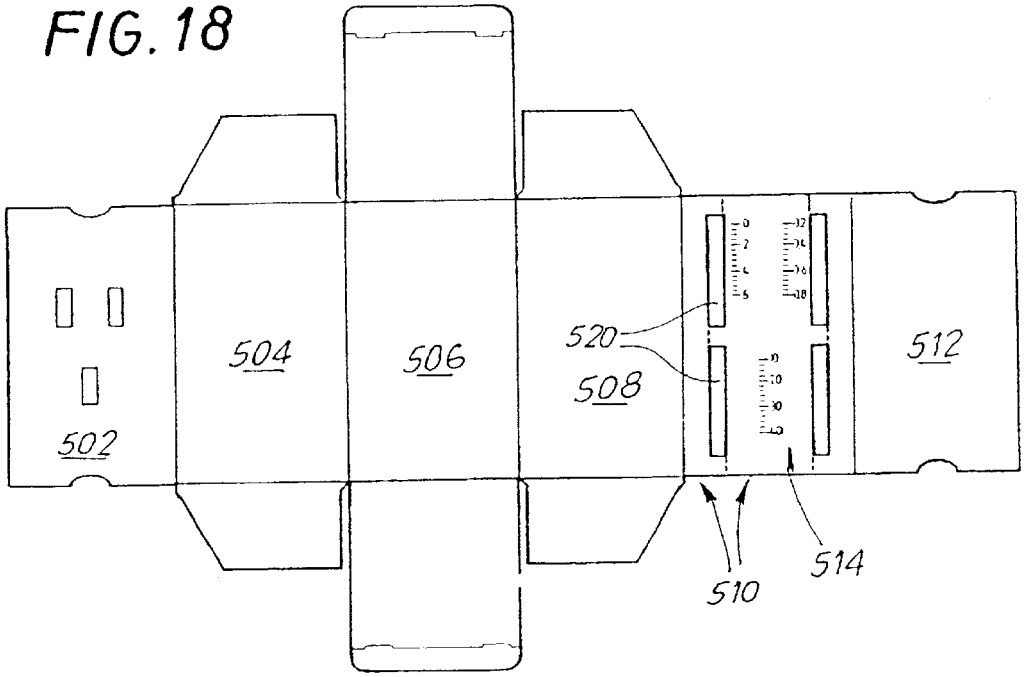
FIGS. 18 to 20 show a further example of a box in a configuration with the blank flattened out and in one assembly step in a perspective view and in transverse section.
Figure 19:
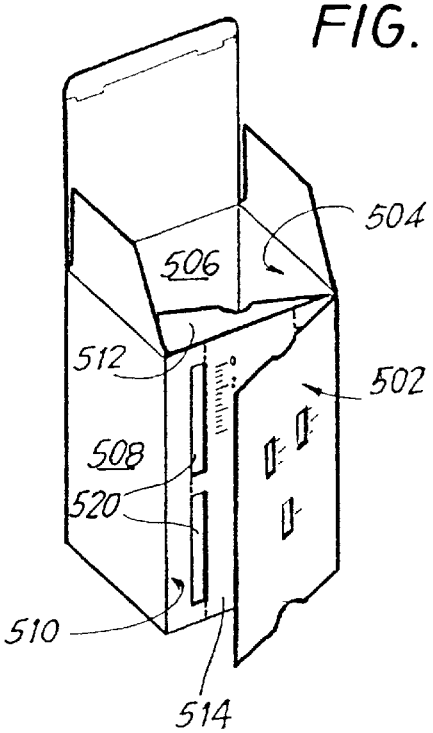
Figure 20:
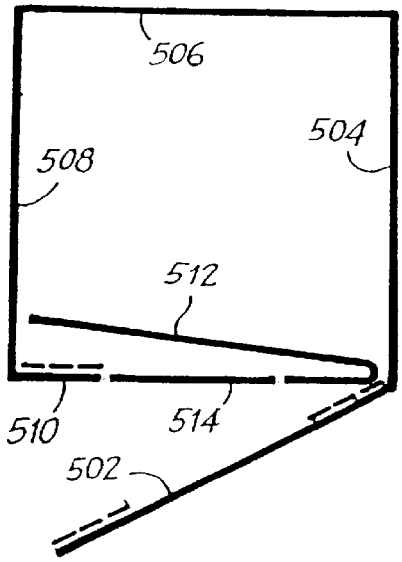

FIGS. 18 to 20 show a solution in the form of a box similar to that described previously with reference to FIGS. 1 to 8; the cursor is made substantially as shown in FIGS. 14 to 16. Faces 502, 504, 506, 508, 510 and 512 are provided; the cursor 514, having a shape similar to that provided in FIGS. 14 to 16, and having apertures 520 running alongside it, is formed in the face 510; the various faces 502 to 512 are folded as shown in FIGS. 19 and 20. The box can be formed with the use of only three gluing strips, as shown in broken lines in FIG. 20, creating the sliding case for the cursor 514 with the faces 502 and 512.

Figure 21:
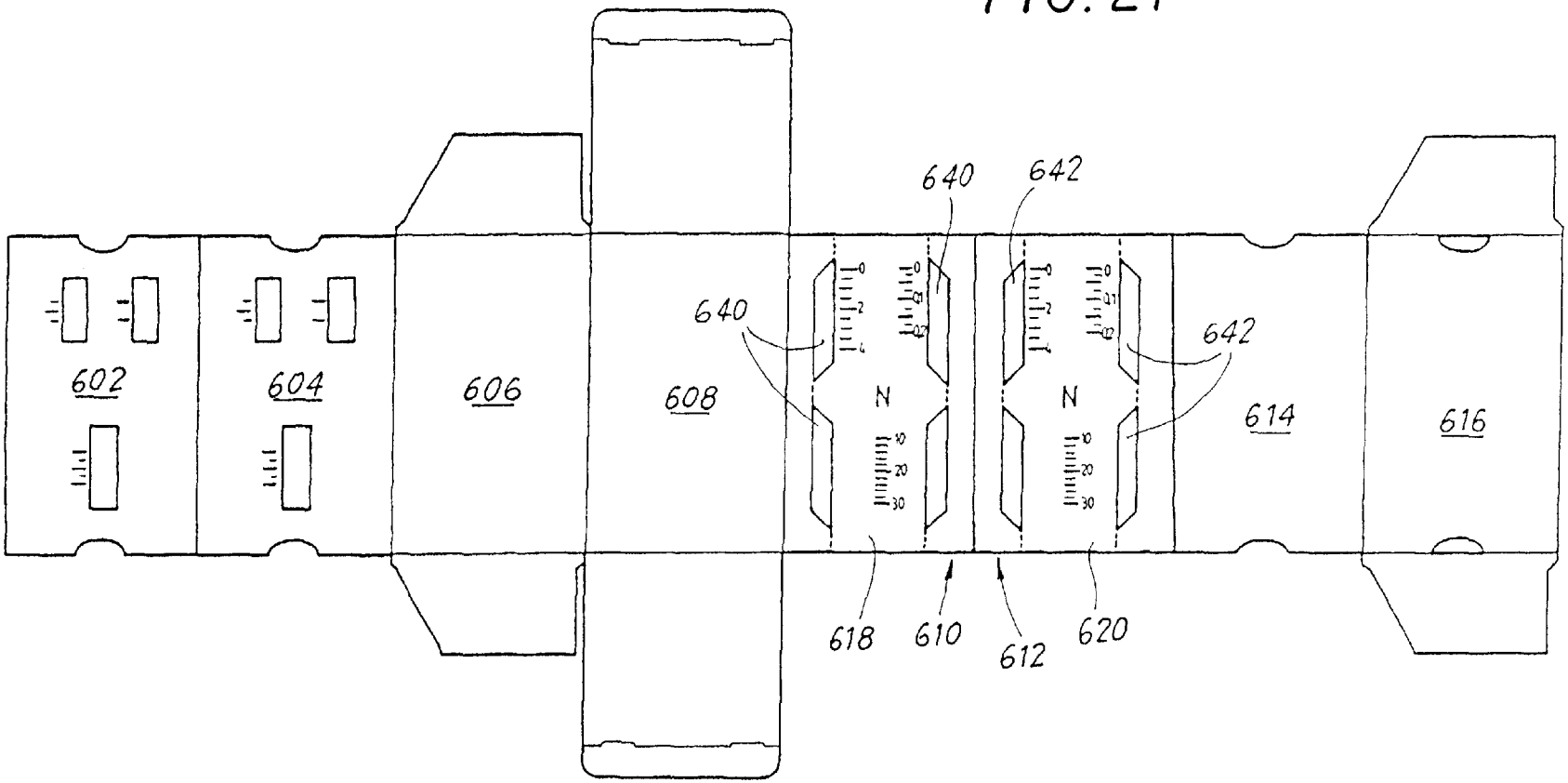
FIGS. 21 to 23 show the blank of a box which has two cursors on two adjacent faces, and a transverse section in an intermediate configuration during assembly and after completion of assembly.
Figure 22:
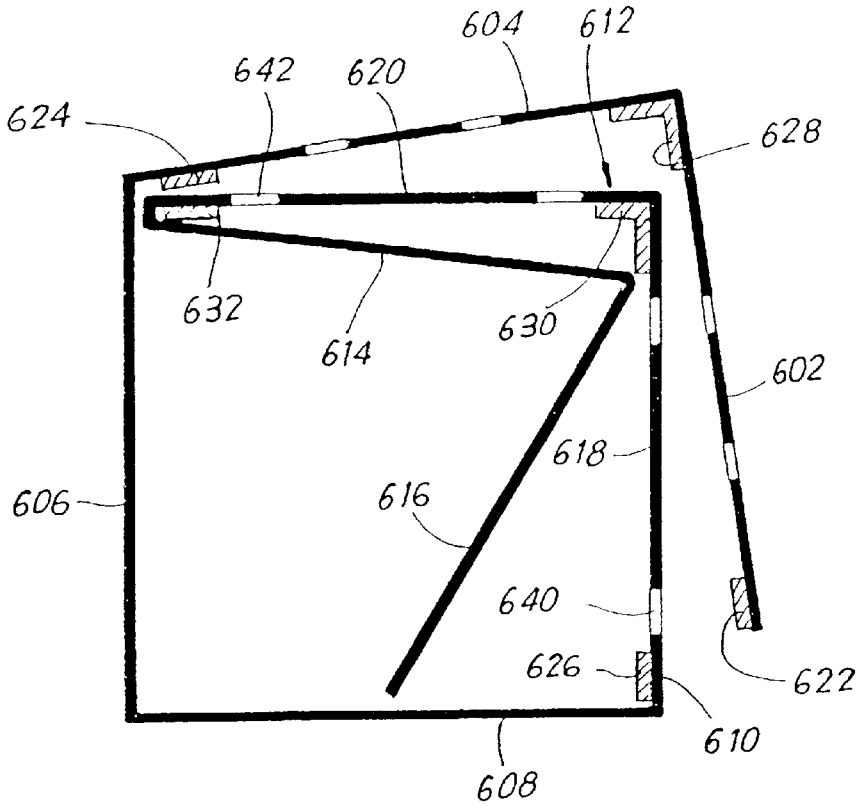
Figure 23:
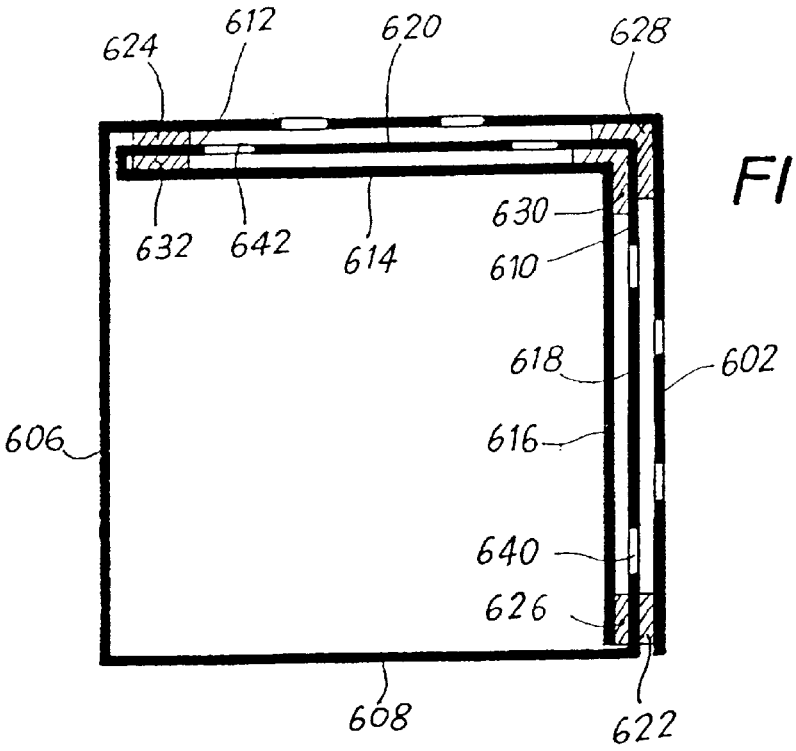

FIGS. 21 to 23 show a solution in the form of a box in which two cursors are provided on two faces, which in the example are adjacent; different positions of the two cursors may also be provided and/or more, than two cursors may also be provided. In the drawn example, the numerals 602, 604, 606, 608, 610, 612, 614, 616 indicate the same number of faces, of which the faces 610 and 612 form two cursors 618 and 620, formed for example as in the example shown in FIGS. 14 to 16, with apertures 640 and 642 running alongside them; the faces 602, 604 have the apertures for reading the data printed on the cursors; the faces 602, 604, 606, 608 form the outer surfaces of the box, which can be printed together with the cursors, the whole of the printing being done on the same side of the blank. To secure the box after the folding operations shown in FIGS. 22 and 23, at least the gluing strips 622, 624 and 626 are used, and preferably also gluing strips 628 and/or 630 and/or 632, all of these being indicated by the hatched thicknesses in FIGS. 22 and 23.

FIGS. 24 and 25 show a solution in which the cursor is formed with a single longitudinal aperture (or pair of longitudinal apertures), instead of with two apertures (or pairs of apertures) running alongside the cursor on opposite sides of it to form the sliding edges. According to FIGS. 24 and 25, a box is formed with six faces 702, 704, 706, 708, 710, 712 of which the faces 702, 704, 706, 708 form the sides of the box; the face 702 has reading slots 714, while the cursor 716 is formed from the material of the face 710. To form the cursor 716, a single longitudinal cut 718 is made on one side, while on the opposite side of the cursor 716 two parallel longitudinal cuts 720, 722 are made, delimiting a longitudinal aperture 724 which is further delimited by a stop 726 on the face 710 and by an opposing stop 728 on the cursor 716; the aperture 724 creates a single discard. The two stops 726, 728 interact to limit the travel of the cursor and to prevent it from accidentally leaving the sliding case delimited between the two faces 702 and 712 and by the two cutting lines 718 and 722. The printing is carried out on one face of the blank (on the faces 702, 704, 706, 708 and 710) while gluing strips are distributed on the opposite face as indicated by the hatching (FIG. 25) on the faces 702 and 710.

FIGS. 26 and 27 and FIGS. 28 and 29 show further embodiments, which are modified—with respect to the preceding examples—to obtain the stops limiting the cursor travel while avoiding the necessity of creating paper discards, in other words waste pieces, which are formed to create the elongate apertures such as the apertures 153, 253, 420, 724 and equivalent; in this way, production is further simplified. To achieve this, the cursor is made to be formed along the perimeter of the blank, instead of in an intermediate position of ore face of the rule or of the box.

Figure 26:
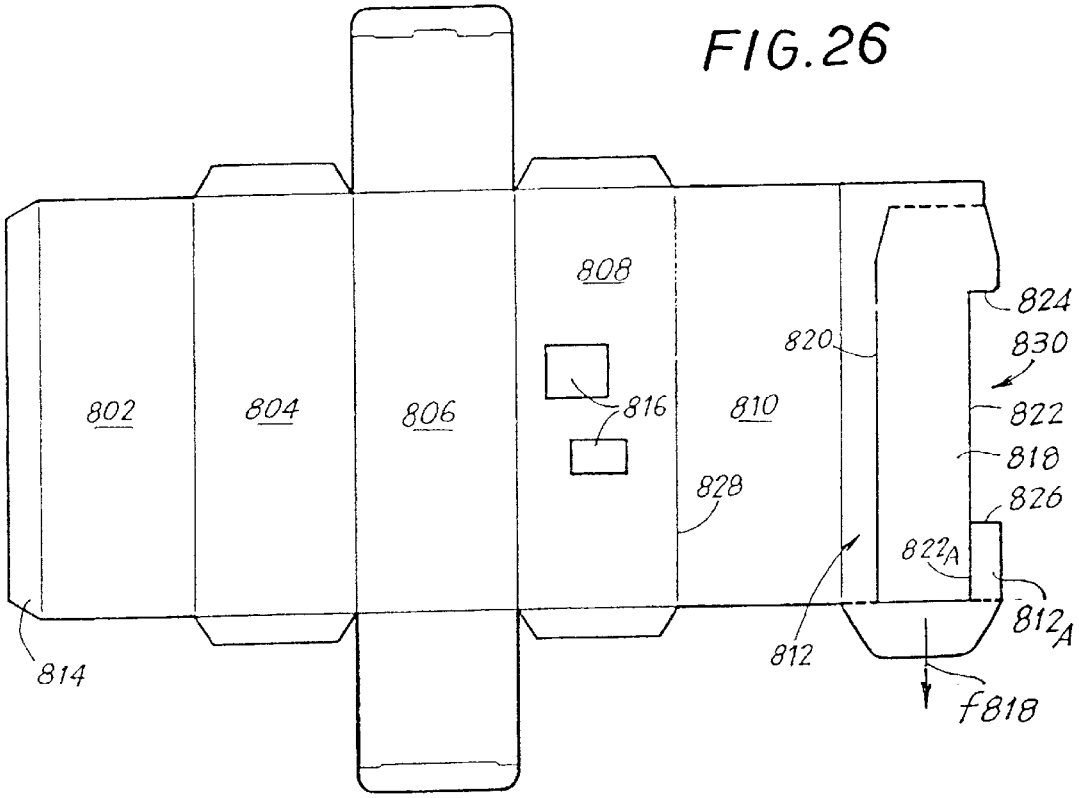
Figure 27:
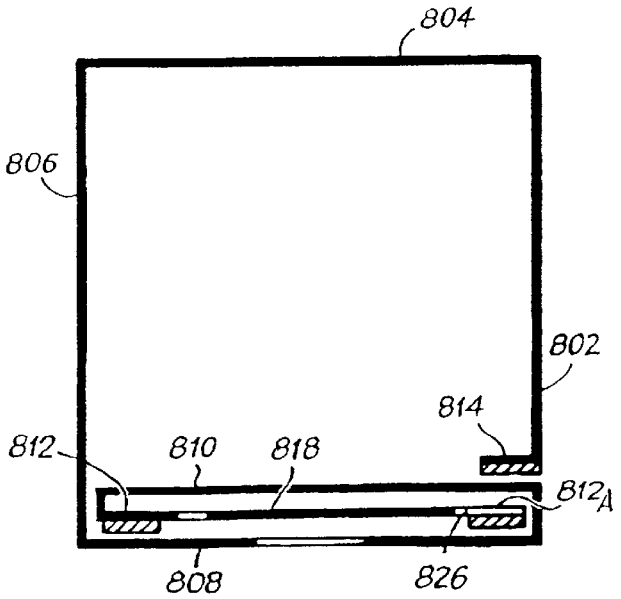

In FIGS. 26 and 27, the blank of a box has faces 802, 804, 806, 808, 810 and 812, and a gluing tab 814. The slots 816 for reading the data printed on the cursor are formed in the face 808. The cursor 818 is formed in the face 812, which is in the end position of the group of faces 802 to 812. The said cursor 818 is delimited by a longitudinal cutting line 820 (which forms sliding edges) and by a cut 822, 822A parallel to and opposite the cut 820; the part 822 of the said cut is located along the perimeter of the blank, between a stop 824 formed by the cursor 818 and a stop 826 formed by a portion 812A of the face 812 and delimited by the cutting line 822A. The cut 822 and the two stops 824 and 826 create an indentation 830 which has the same function as an aperture running alongside the cursor. The two stops 824 and 826 interact to limit the travel of the cursor 818 in the direction of the arrow f818 and thus to prevent the cursor 818 from accidentally leaving its sliding case, which is delimited by the two faces 810 and 808, the cut 820, the cut 822A in the side of the portion 812A and the fold line 828 between the two faces 808 and 810. Printing is made to be carried out on the faces 808, 806, 804, 802 and on the cursor 818 or the same side of the blank, and the gluing strips are distributed on the opposite side of the said blank, as indicated by the hatching in FIG. 27.

Figure 28:
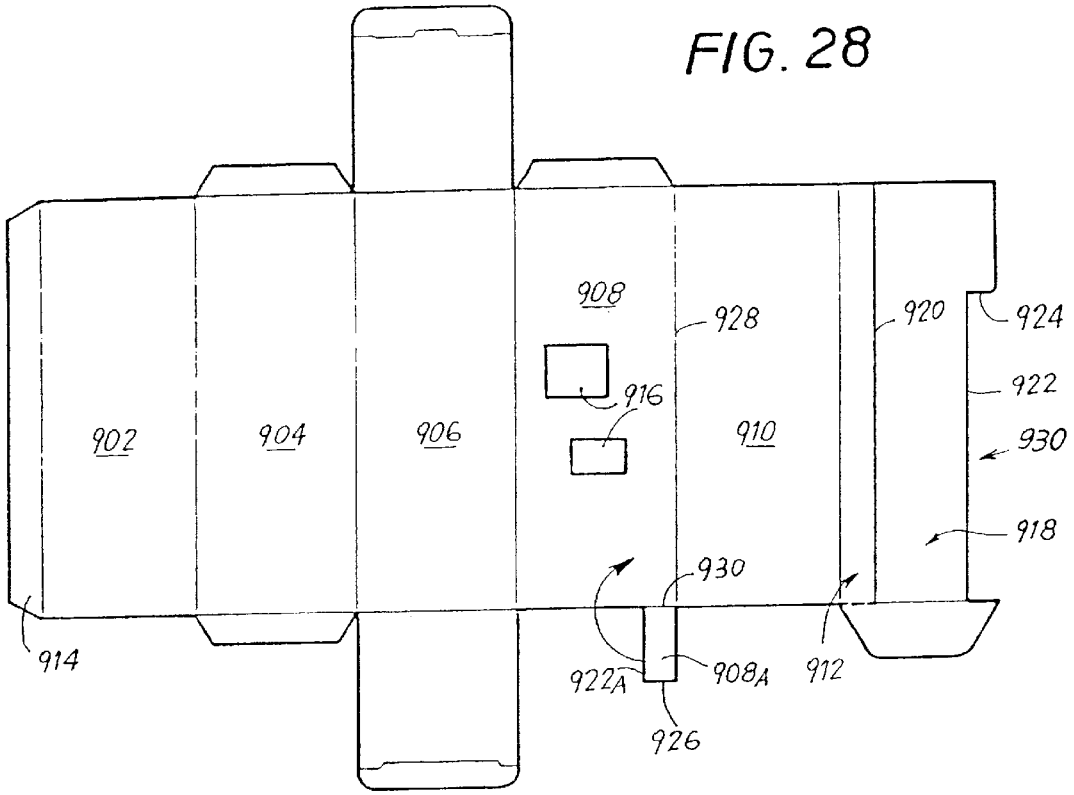
Figure 29:
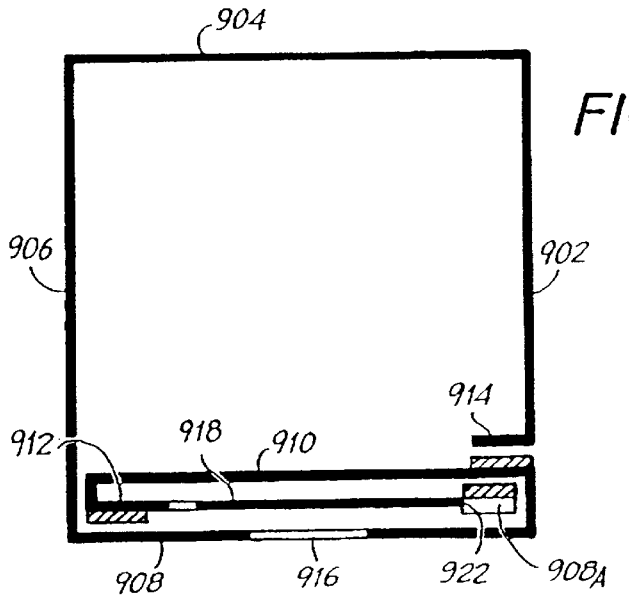

FIGS. 28 and 29 show a variant of the embodiment shown in FIGS. 26 and 27. Parts corresponding to those of the embodiment in FIGS. 26 and 27 are indicated in FIGS. 28 and 29 with the same reference numerals used in FIGS. 26 and 27, increased by "100". The variant relates to the formation of the stop 926 (having the same function as the stop 826) to interact with the stop 924 (equivalent to the stop 824). In the said variant, the cut 922 does not delimit a portion such as the portion 812A; the stop 926 is formed from an appendage 908A of the face 908, which is folded about the fold line 930 against the face 908 and glued there; this appendage 908A therefore comes to be located—when the box is assembled—between the two faces 908 and 912 (exactly as the portion 812A is located between the two faces 808 and 812), thus creating the stop 926 and the guide 922A in the same position and with the same functions as the stop 826 and the guide cut 822A between the faces 808 and 812.

It is to be understood that the drawing shows only an example provided solely as a practical demonstration of the invention, which invention may be varied in its forms and dispositions without departing from the scope of the guiding concept of the invention. Any presence of reference numerals in the attached claims has the purpose of facilitating the reading of the claims with reference to the description and to the drawing, and does not limit the scope. of the protection represented by the claims.

What is claimed is:

1. Device forming a slide rule and indicator, being made of laminar material, comprising a portion including tree layered thicknesses of which two outer ones of said thicknesses form a case and an intermediate one of said thicknesses forms a cursor designed to slide in the case, characterized in that the cursor is formed in said intermediate thickness by cuts parallel to the direction of sliding of the cursor and by weak links designed to be broken by action on the cursor which causes its initial sliding, and that said cuts parallel to the direction of sliding of the cursor form an elongate slot running alongside the cursor and terminating in a cursor stop formed by the cursor and a frame stop formed by the material of the intermediate thickness from which the cursor is formed, the two stops interacting to limit the sliding of the cursor with respect to the case.

2. Device according to claim 1, characterized in that the two stops are inclined with respect to the direction of sliding of the cursor and with respect to the perpendicular to the said direction of sliding, to obtain an angle of less than 90° between the edges which slide with respect to each other.

3. Device according to claim 1, characterized in that said elongated slot is formed with another cut parallel to the direction of sliding and with removal of a discard.

4. Device according to claim 1, characterized in that said elongated slot is formed by a perimetric shaping of the intermediate thickness, in which the cursor is formed along the perimeter of the intermediate thickness.

5. Device according to claim 1, characterized in that the cursor is integral with a closing tab which forms a gripping surface for the sliding of the cursor.

6. Device according to claim 1, characterized in that the weak links designed to be broken on the occasion of the initial sliding of the cursor are formed along lines which are inclined with respect to the direction of the sliding cursor.

7. Device according to claim 1, characterized in that said outer ones of said thicknesses form the wall of a box.

8. A box including a device forming a slide rule and indicator according to claim 1.

9. A device in accordance with claim 1, further comprising:

another elongated slot running alongside the cursor and formed by said cuts, said elongated slot and said another elongated slot being arranged on opposite sides of the cursor.

10. A device in accordance with claim 1, wherein:

said case includes another frame stop, said frame stop and said another frame stop form two outer stops of said elongated slot;

said cursor stop is movable in an interspace delimited by the two outer stops, said cursor stop divides said elongated slot into first and second apertures.

11. A prismatic box made of laminar material, the box comprising:

a plurality of walls;

one of said plurality of walls of said box is formed by a ruler having a portion including three layered thicknesses two of which form an outer surface and an inner surface of said wall and together form a case for a cursor and an intermediate one of said thicknesses forms said cursor designed to slide in said case;

the cursor is formed in said intermediate thickness by cuts parallel to the direction of sliding of the cursor and by weak links designed to be broken by action on the cursor which causes its initial sliding; and said cuts parallel to the direction of sliding of the cursor form at least one elongate slot running alongside the cursor and terminating in a stop formed by the cursor and a stop formed by the material of the intermediate thickness from which the cursor is formed, the two stops interacting to limit the sliding of the cursor with respect to the case.

12. A box according to claim 11, wherein:

another one of said plurality of walls of said box is formed by a ruler having a portion including three layered thicknesses two of which form an outer surface and an inner surface of said another of said walls and together form another case for another cursor and an intermediate one of said thicknesses of said another wall forms said another cursor designed to slide in said another case;

said another cursor is formed in said intermediate thickness of said another wall by cuts parallel to the direction of sliding of the another cursor and by weak links designed to be broken by action on the another cursor which causes its initial sliding; and said cuts parallel to the direction of sliding of the another cursor form another elongate slot running alongside the another cursor and terminating in another stop formed by the another cursor and another stop formed by the material of the intermediate thickness from which the another cursor is formed, the two another stops interacting to limit the sliding of the another cursor with respect to the another case.

13. A slide rule arrangement comprising:

a first pane;

a second pane arranged adjacent to said first pane, said first and second panes forming a case;

a cursor pane arranged in sad case, said cursor pane including a cursor and a frame surrounding said cursor, said frame defining a frame open said cursor being arranged in said frame opening, said frame opening and said cursor having a shape to cause said cursor to be movable in said frame opening, said case and said shape of said frame opening and said cursor blocking removal of said cursor from said case, said cursor and said frame being connected by links which are breakable to cause said cursor to be slidable in said case.

14. An arrangement in accordance with claim 13, wherein:

said shape of said frame opening and said cursor cause said cursor to be slidable back and forth along only one direction, said shape of said frame opening and said cursor limiting sliding of said cursor in said one direction.

15. An arrangement in accordance with claim 14, wherein:

said shape of said frame opening and said cursor include longitudinal sides substantially parallel to said one direction and adjacent to each other.

16. An arrangement in accordance with claim 13, wherein:

said shape of said frame opening and said cursor define a slot between said frame opening and said cursor.

17. An arrangement in accordance with claim 13, wherein:

said first, second and cursor panes form a homogenous sheet.

18. An arrangement in accordance with claim 17, wherein:

said first, second and cursor panes are connected by fold lines.

19. An arrangement in accordance with claim 13, further comprising:

a plurality of additional panes connected to said first and second panes to form a container, said case forming one side of said container.

* * * * *